United States Patent [19]

Petrov et al.

[11] 4,008,596

[45] Feb. 22, 1977

[54] APPARATUS FOR TRANSFORMING THE CROSS-SECTION OF A THIN-WALLED CYLINDER

[75] Inventors: Radoslav Stanev Petrov; Stefan Elenkov Zahariev; Ivan Kirilov Markov; Georgi Vassilev Peychev, all of Sofia, Bulgaria

[73] Assignee: DSO "Montagi" , Sophia, Bulgaria

[22] Filed: Dec. 19, 1975

[21] Appl. No.: 642,495

[30] Foreign Application Priority Data

Dec. 19, 1974 Bulgaria ..... 28504

[52] U.S. Cl. ..... 72/176; 72/370; 29/157 R

[51] Int. Cl.[2] ..... B21D 41/00

[58] Field of Search ..... 72/127, 176, 370; 113/120 M; 228/155, 156; 29/157 R

[56] References Cited

UNITED STATES PATENTS

| | | | |
|---|---|---|---|
| 3,056,447 | 10/1962 | Powell et al. | 113/120 M |
| 3,324,534 | 6/1967 | Spurk | 29/157 R |
| 3,662,583 | 5/1972 | Moore | 72/370 |

*Primary Examiner*—Lowell A. Larson

[57] ABSTRACT

An arrangement for working the interior cross-section of a thin-walled circular pipe or other cylinder to a symmetrical, non-circular cross-section such as a rectangular or a flat-oval form is described. The pipe to be worked is advanced over and into contact with a conforming mandrel whose outer surface has a cross-section that corresponds to the internal, initially round cross-section of the pipe. The mandrel is provided with an outer cross-section that varies axially from an input round cross-section corresponding to that of the pipe to an output cross-section that matches the final configuration of the worked pipe, while exhibiting a constant peripheral dimension throughout its length. The mandrel is made freely-rotatable about its axis as the pipe is advanced along and in contact with the mandrel in order to maintain a coaxial configuration of the resulting contoured pipe.

4 Claims, 6 Drawing Figures

APPARATUS FOR TRANSFORMING THE CROSS-SECTION OF A THIN-WALLED CYLINDER

BACKGROUND OF THE INVENTION

The invention relates to facilities for transforming the internal cross-section of a thin-walled pipe or other cylinder into a non-circular, symmetrical closed form. More particularly, the invention relates to apparatus of such type which performs the required working of the pipe while the pipe is axially advanced in a first direction.

In previous techniques for converting a round pipe into other suitable shapes (such as rectangular, flat-oval and the like) useful for applications as air-conditioning ducts, cable protectors, etc., it has been common to provide cooperating internal and external jaws which are suitably positioned and configured to distort discrete sections of the pipe into the desired shape. In such arrangements, the jaws are hydraulically of pneumatically actuated.

Such arrangements have the disadvantage of being extremely bulky and heavy, as well as expensive to run and maintain. Additionally, it is difficult and cumbersome to interchange the operating jaws to accommodate different types of final, non-circular cross-sections, and in any event are adapted to handle only relatively short sections of pipe.

SUMMARY OF THE INVENTION

All of such disadvantages are overcome with the pipeworking apparatus in accordance with the invention, such apparatus being particularly adapted to vary the contour of thin-walled metal pipes formed, e.g., with a screw-type longitudinal fold seam.

In an illustrative embodiment, the pipe is axially advanced onto the input end of a cylindrical mandrel whose outer surface is adapted to tightly engage the inner surface of the advancing pipe. The outer surface contour of the mandrel is so arranged that its cross-section varies from the input round shape, conforming to the pipe, to a final non-circular shape that matches the desired internal cross-section of the finished duct. Such outer surface of the mandrel is also so arranged that its periphery remains constant throughout its length.

As a result, the advancing pipe is continually and gradually urged from its initial first cross-section to the desired second cross-section as it slidably engages the mandrel along the first direction.

In order to assure that the center of symmetry of the finished pipe coincides with the center of symmetry of the original round pipe, the mandrel is made freely rotatable about the first axis.

In order to accommodate different desired final shapes of the finished duct, the mandrel is advantageously made from a plurality of axially removable and mutually abutting portions whose outer surfaces cooperate to form a continuous transition along their length from the first cross-section at the input end of the first portion to the second cross-section at the output end of the final portion.

BRIEF DESCRIPTION OF THE DRAWING

The invention is further set forth in the following detailed description taken in conjunction with the appended drawing, in which.

DETAILED DESCRIPTION

Figure 1:
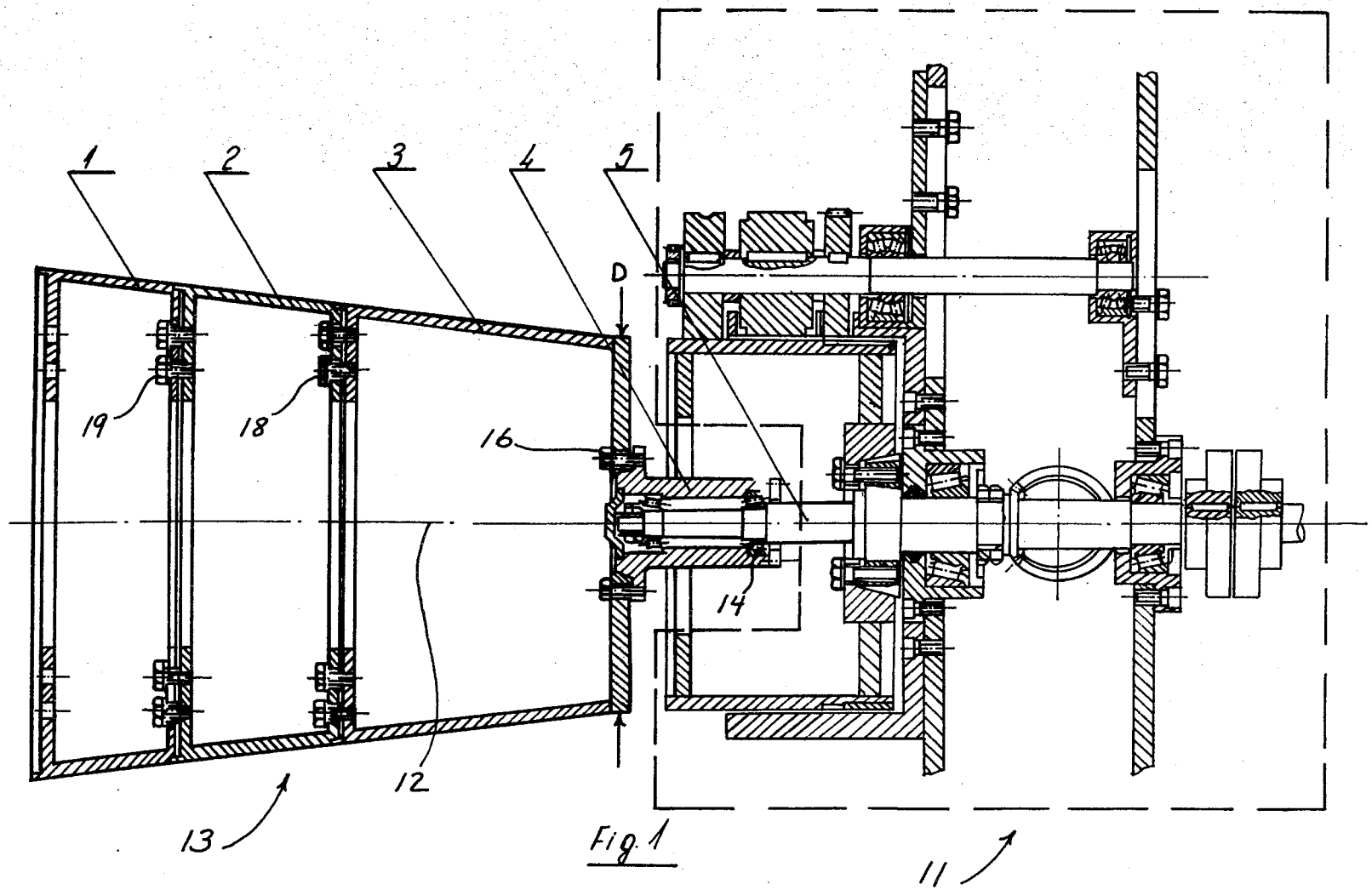
FIG. 1 is a longitudinal section through an illustrative apparatus in accordance with the invention for altering the cross-section of an initially circular pipe.

Referring now to the drawing, FIG. 1 depicts, at its right end, a representation of a machine 11 for producing a continuous length of a circular cylinder, illustratively thin-walled pipe (not shown) having a screw-type longitudinal seam. Such machine has an output shaft 5 (representative, e.g., of a pipe winding and sizing drum), which is rotatable about an axis 12. The thin-walled pipe emerging from the machine 11 is axially advanced over the shaft 5 in a direction to the left as viewed in the drawing by suitable facilities not shown; and the internal circular cross-section of the pipe is assumed to correspond to a diameter indicated at D in FIG. 1.

The internal cross-section of the advancing thin-walled pipe is brought initially into engagement with a circular outer cross-section of a mandrel 13, and in particular with an input portion 3 thereof. Such initial outer cross-section of the mandrel is adapted to tightly engage the inner surface of the pipe. Such mandrel 13 is mounted for free rotation about the axis 12 by means of a hub 4 that is supported for rotation with respect to the machine shaft 5 via a set of roller bearings 14, 14 and which is secured at its outer end via bolts 16, 16 to a flange 17 of the input mandrel section 3.

The outer surface of the mandrel 13 exhibits a continuous axial variation from the initial round configuration exhibited by the flange 17 to a symmetrical, non-circular configuration at the output end of the mandrel, represented at the left-most portion of FIG. 1. Notwithstanding such variation of cross-section, each cross-sectional plane of the mandrel 13 exhibits the same peripheral dimension. With this arrangement, as the initially round pipe is advanced over the mandrel 13 in a direction to the left as viewed in the drawing, the internal cross-section of such pipe is continually and gradually urged into correspondence with the then-occurring cross-sectional shape of the mandrel outer surface, so that by the time the appropriate plane of the pipe has reached the outer end of the mandrel, such pipe will exhibit the final non-circular shape of such mandrel outer end. The free rotation of the mandrel 13 about the axis 12, which is permitted by the rotational mounting of the hub 4 with respect to the machine shaft 5, is effective to maintain the axis of symmetry of the pipe during its working by the mandrel outer surface.

In order to quickly and easily adapt the arrangement depicted in FIG. 1 to various configurations of the final cross-sectional shape of the pipe to be worked, the mandrel 13 may be formed from a plurality of selectively removable axial sections whose outer surfaces cooperate to provide the continuous axial variation indicated above. In FIG. 1, for example, an intermediate mandrel portion 2 is disposed in abutting relation with the first mandrel portion 3, and is secured thereto by means of bolts 18, 18. As indicated, the input end of the mandrel section 2 forms a continuation of the outer end of the mandrel section 3.

Further, an additional outer mandrel section 1 is removably secured to the intermediate section 2 by means of bolts 19, 19. The mandrel section 1, which will determine the final outer configuration of the worked pipe, has an outer surface which forms a continuation of the outer surface of the mandrel sections 2, 3.

Figure 2:
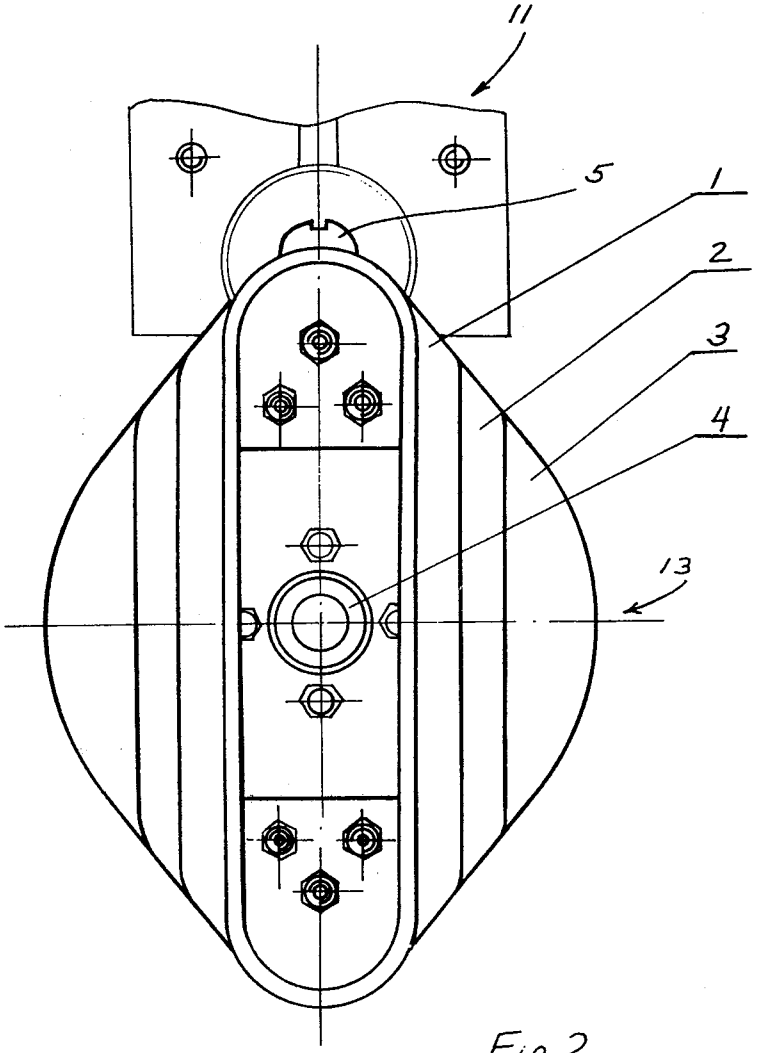
FIGS. 2 and 3 are respectively end views of the arrangement of FIG. 1 when the apparatus is adapted for converting the initially circular pipe into a flat-oval and rectangular cross-section, respectively, certain details of FIG. 2 being omitted in FIG. 3 for simplicity.
Figure 3:
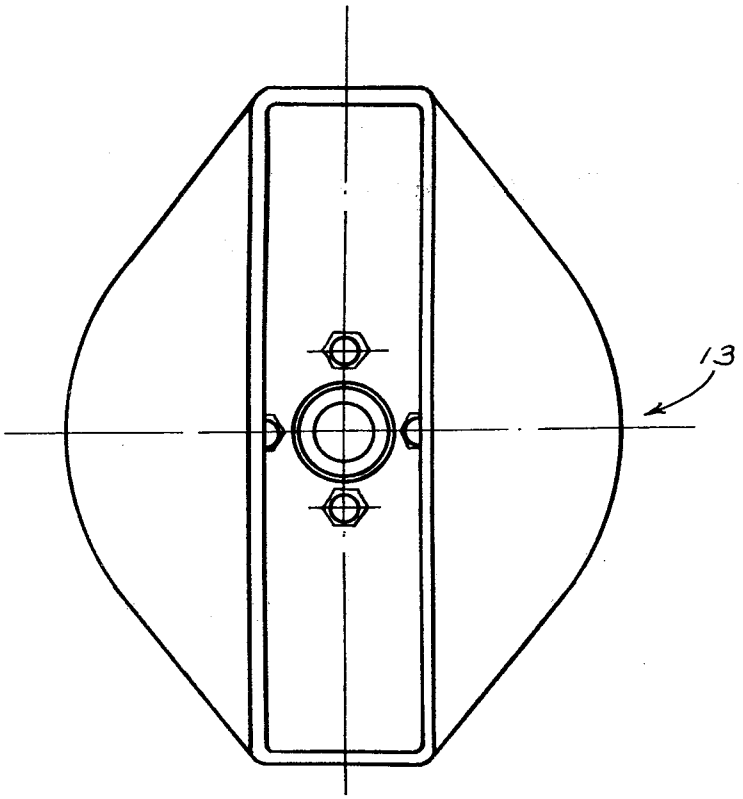

FIG. 2 illustrates the gradual transition of outer cross-section of the mandrel 13 in the particular case where the final configuration of the worked pipe is to be flat-oval. A similar representation, wherein the final configuration of the pipe is to be rectangular, is shown in FIG. 3. In each case, the overall peripheral dimension of the mandrel 13 at any portion of the constituent sections 1–3 will be constant as noted above.

Figure 4:
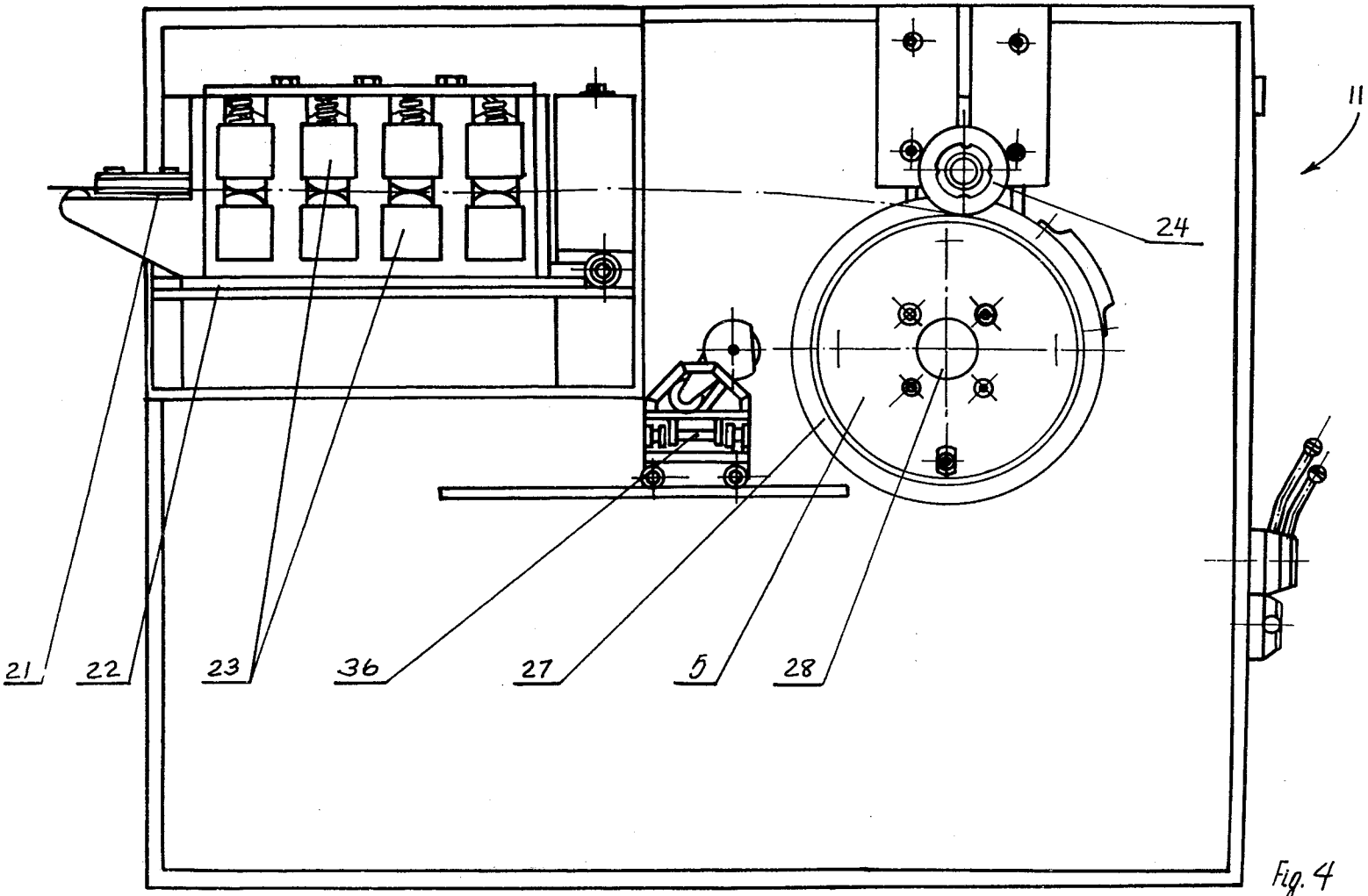
FIG. 4 is a front elevation of an illustrative machine for producing thin-walled pipe.
Figure 5:
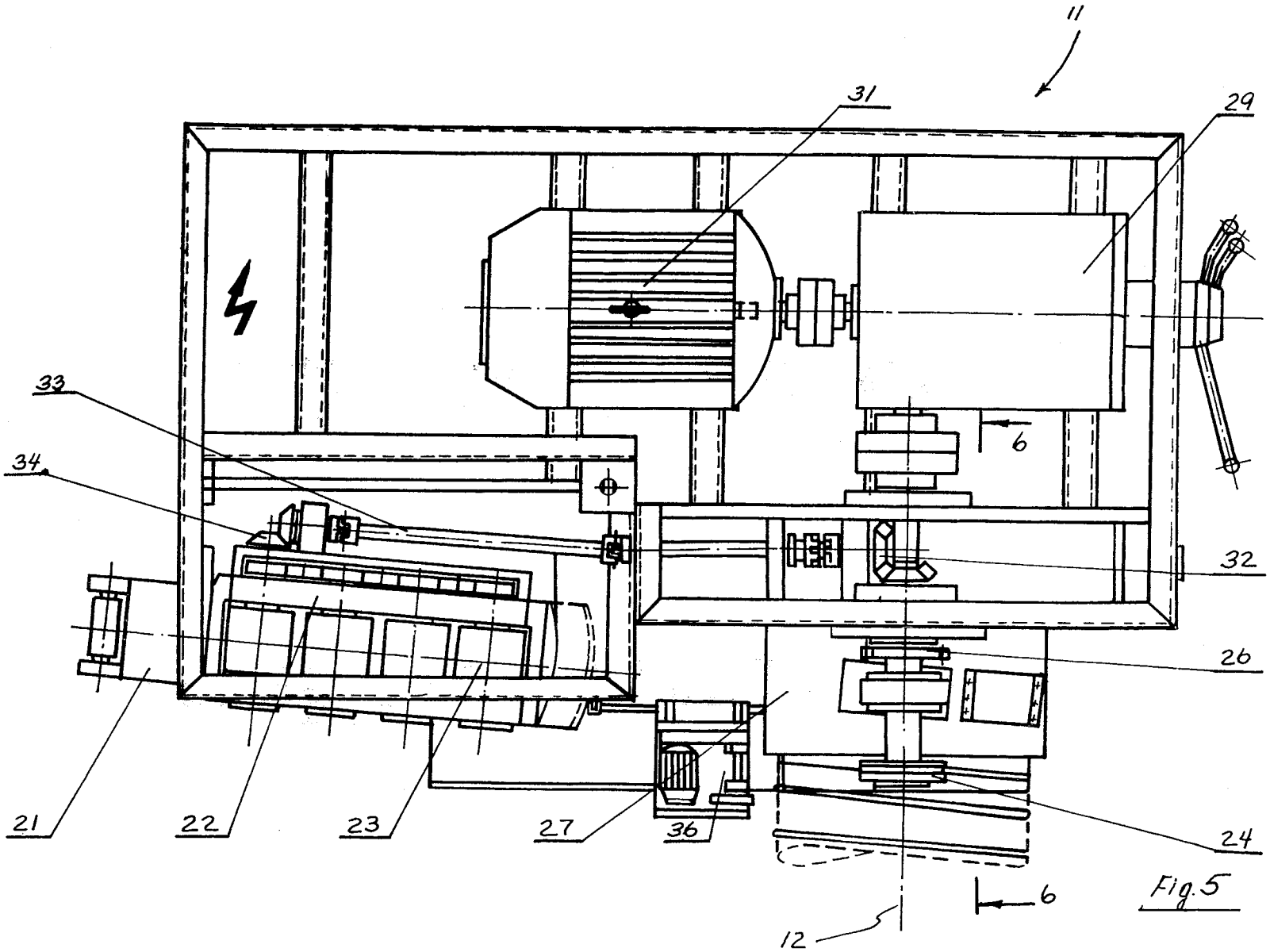
FIG. 5 is a plan view of the machine of FIG. 4.
Figure 6:
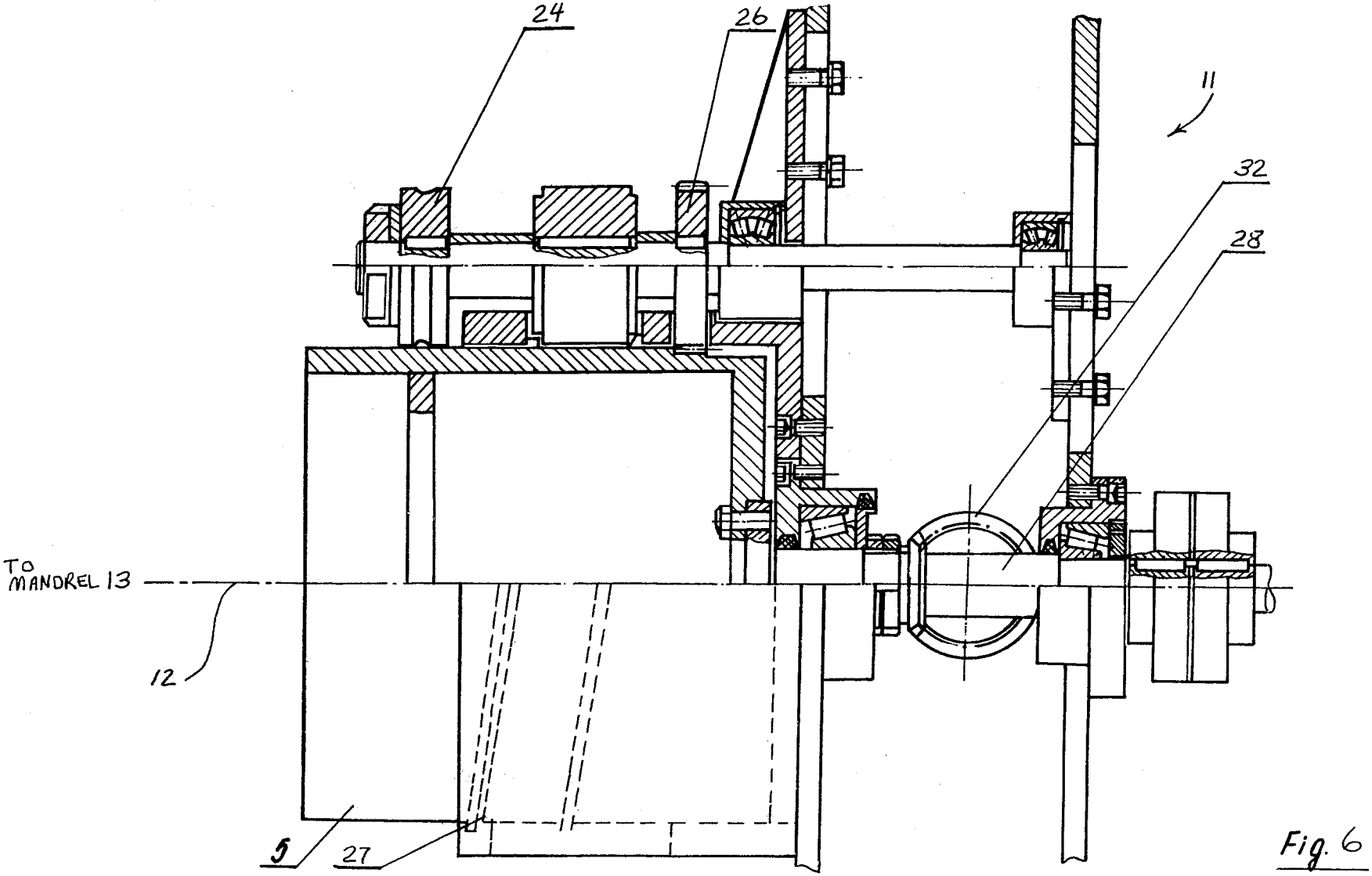
FIG. 6 is a sectional view taken along line 6—6 of FIG. 5.

For purposes of illustration, one embodiment of a machine 11 for producing thin-walled round pipe which may be worked in accordance with the facilities of FIGS. 1–3 is depicted in FIGS. 4–6. Steel strip (not shown) to be formed into circular pipe is first advanced via a guiding device 21 (FIG. 4) through a strip-profiling block 22, adapted for producing seams in the strip. The block 22 includes four cooperatively driven, dual profiling rollers 23, 23 which contact both sides of the incoming strip. The rollers 23 may be suitably supported on bearings in the block 22, which in turn may be movable both horizontally and vertically on the machine frame.

From the block 22, the now-folded strip may be drawn and wound into pipe by a suitably driven sizing drum 5, which as indicated above may be represented by the correspondingly numbered shaft in FIG. 1. The folds in the strip are compressed between the drum periphery and a roller 24, which in turn is driven by a gear 26 that is engageable with a toothed portion on the periphery of the drum.

A push-out bushing 27 is affixed coaxially around the drum 5 along about ¾ of the length of the drum. The bushing 27 has an internal cylindrical surface including a helical screw groove with two turns. A first one of the turns illustratively has a rectangular cross-section, and the other of the turns has a trapezoidal cross-section. The bushing 27 permits the formed pipe to be advanced off the drum 5 along the axis 12, and prevents harmful deformations while the pipe is being formed.

The drum 5 may be rotated about the axis 12 by means of a spindle 28 at the output of a gear reducer 29. The input of such reducer is coupled to an electric motor 31.

The rollers 23 on the strip profiling block 22 are driven by the spindle 28 via bevel gears 32, a cardan shaft 33 and a pair of gear wheels 34.

If desired, a pipe section cutoff device 36 may be disposed adjacent the drum 5 as shown.

In the foregoing, illustrative arrangements of the invention have been described. Many variations and modifications will now occur to those skilled in the art. It is accordingly desired that the scope of the appended claims not be limited to the specific disclosure herein contained.

What is claimed is:

1. In an apparatus for transforming the internal cross-section of a thin-walled cylinder, advanceable in a first direction along a first axis, from a first circular form to a second symmetrical, non-circular closed form, a cylindrical mandrel coaxial with the thin-walled cylinder, the mandrel having an outer surface aligned with and corresponding at its input end in shape to the first circular form of the advancing pipe, the contour of the outer surface of the mandrel varying in the first direction from the first circular form at its input end to the second non-circular form at its output and, whereby the internal cross-section of the cylinder is constantly and gradually urged from the first form to the second form as the cylinder traversed the mandrel, the improvement wherein the circumference of the mandrel is constant throughout the length thereof and wherein the apparatus further comprises means supporting the mandrel for rotation about the first axis.

2. Apparatus as defined in claim 1, in which the mandrel comprises, in combination, a first input portion, and a second output portion coaxially aligned with and having an input end removably affixed to an output end of the first portion, the cross-section of the outer surface on the outer end of the first portion corresponding to the cross-section of the outer surface on the input end of the second portion.

3. Apparatus as defined in claim 1, in which the outer surface of the second portion exhibits a rectangular cross-section at its output end.

4. Apparatus as defined in claim 1, in which the outer surface of the second portion exhibits a flat-oval cross-section at its output end.

* * * * *